US005293936A

United States Patent [19]

Bridges

[11] Patent Number: 5,293,936

[45] Date of Patent: Mar. 15, 1994

[54] OPTIMUM ANTENNA-LIKE EXCITERS FOR HEATING EARTH MEDIA TO RECOVER THERMALLY RESPONSIVE CONSTITUENTS

[75] Inventor: Jack E. Bridges, Park Ridge, Ill.

[73] Assignee: IIT Research Institute, Chicago, Ill.

[21] Appl. No.: 837,315

[22] Filed: Feb. 18, 1992

[51] Int. Cl.[5] ..... E21B 43/24; E21B 43/30

[52] U.S. Cl. ..... 166/248; 166/60

[58] Field of Search ..... 166/248, 302, 60; 219/10.55 R, 10.81

[56] References Cited

U.S. PATENT DOCUMENTS

| | | | |
|---|---|---|---|
| Re. 30,738 | 9/1981 | Bridges et al. . | |
| 2,757,738 | 8/1956 | Ritchey . | |
| 3,170,519 | 2/1965 | Haagensen . | |
| 4,135,579 | 1/1979 | Rowland et al. . | |
| 4,140,179 | 2/1979 | Kasevich et al. . | |
| 4,140,180 | 2/1979 | Bridges et al. . | |
| 4,144,935 | 3/1979 | Bridges et al. . | |
| 4,183,407 | 1/1980 | Knopik | 166/314 |
| 4,196,329 | 4/1980 | Rowland et al. . | |
| 4,301,865 | 11/1981 | Kasevich et al. . | |
| 4,320,801 | 3/1982 | Rowland et al. . | |
| 4,323,122 | 4/1982 | Knopik . | |
| 4,449,585 | 5/1984 | Bridges et al. . | |
| 4,457,365 | 7/1984 | Kasevich et al. . | |
| 4,458,754 | 7/1984 | Barnes et al. . | |
| 4,487,257 | 12/1984 | Dauphine . | |
| 4,498,535 | 2/1985 | Bridges . | |
| 4,508,168 | 4/1985 | Heeren . | |
| 4,513,815 | 4/1985 | Rundell et al. . | |
| 4,524,826 | 6/1985 | Savage . | |
| 4,524,827 | 6/1985 | Bridges et al. . | |
| 4,553,592 | 11/1985 | Looney et al. . | |
| 4,592,423 | 6/1986 | Savage et al. . | |
| 4,620,592 | 11/1986 | Perkins . | |
| 4,638,862 | 1/1987 | Savage . | |
| 4,660,636 | 4/1987 | Rundell et al. . | |
| 4,670,634 | 6/1987 | Bridges et al. . | |
| 4,705,108 | 11/1987 | Little et al. . | |
| 4,790,375 | 12/1988 | Bridges et al. . | |
| 4,956,535 | 9/1990 | Buelt et al. | 166/248 X |
| 4,973,811 | 11/1990 | Bass . | |
| 5,065,819 | 11/1991 | Kasevich . | |

OTHER PUBLICATIONS

Carlson, R. D., et al., "Development of the IIT Research Institute RF Heating Process for In Situ Oil Shale/Tar Sand Fuel Extraction–An Overview," 14th Oil Shale Symposium Proceedings, Colorado Schl. of Mines, Golden, Colo., Apr. 22–24, 1981, pp. 138–145.

King, R. W. P., et al., "The Electromagnetic Field of an Insulated Antenna in a Conducting or Dielectric Medium," IEEE Trans. on Microwave Theory and Techniques, vol. MTT-31, No. 7, Jul. 1983, pp. 574–583.

Dev, H., et al., "Decontamination of Hazardous Waste Substances from Spills and Uncontrolled Waste Sites by Radio Frequency In Situ Heating," Proc. of the 1984 Hazardous Materials Spills Conf., Nashville, Tenn., Apr. 1984.

Dev, H., "Radio Frequency Enhanced In-Situ Decontamination of Soils Contaminated with Halogenated Hydrocarbons," Proc. of the 12th Annual Research Symposium, U.S. EPA, Apr. 21–23, 1986.

(List continued on next page.)

*Primary Examiner*—William P. Neuder

*Attorney, Agent, or Firm*—Fitch, Even, Tabin & Flannery

[57] ABSTRACT

Optimum antenna-like exciters for heating earth media which may be used to recover hydrocarbons. A high frequency power supply is connected to an exciter emplaced in the subsurface formation which radiates high frequency power. The exciters include one or more conducting cylinders which make up monopole and dipole antenna-like apparatus. Substantially uniform heating of the subsurface formation is provided thus suppressing excessive heating of edge and power input regions. The equal distribution of electric fields eliminates intense electric fields which would normally exist thus mitigating excessively heated regions and providing substantially uniform heating of the subsurface formation.

22 Claims, 9 Drawing Sheets

OTHER PUBLICATIONS

Dev, H., P. Condorelli, J. Bridges, C. Rogers and D. Downey, "In Situ Radio Frequency Heating Process for Decontamination of Soil," Solving Hazardous Waste Problems, ACS Symposium Series 338, 1987.

"New Waste Site Decontamination Method Proves Successful In Field Test," IITRI News Release, Jun. 29, 1988.

Dev, Harsh and Douglas Downey, "Zapping Hazwastes," Civil Engineering, Aug. 1988, pp. 43–45.

Dev, Harsh, G. C. Sresty, J. E. Bridges and D. Downey, "Field Test of the Radio Frequency In Situ Soil Decontamination Process," published in the proceedings of Superfund '88; HMCRI's 9th Nat'l Conf. and Exhibition., Nov. 28–30, 1988, Washington, D.C.

Buettner, H. M. and W. D. Daily of the Elect. Eng. Dept. and Abelardo L. Ramirez of the Earth Sci. Dept. of Lawrence Livermore Nat'l Laboratory, "Enhancing Vacuum Extraction of Volatile Organics Using Electrical Heating," publication unknown, Mar. 30, 1992.

OPTIMUM ANTENNA-LIKE EXCITERS FOR HEATING EARTH MEDIA TO RECOVER THERMALLY RESPONSIVE CONSTITUENTS

BACKGROUND OF THE INVENTION

Many sections of the earth which are contaminated with hazardous materials lie in layers, often 10 or more feet below the surface and are some are 10 to 50 feet thick. The contaminants are often volatiles such as gasoline, and semi-volatiles, such as jet fuel. It is known that such fuels and other such contaminants pose known or possible health hazards. Conventional remediation means, such as incineration or low temperature volatilization in an on-site retort, require excavation, which becomes prohibitively expensive if layers of uncontaminated overburden must be removed. In addition, the costs of transport and incineration itself, as well as site restoration, are quite high.

One proven in situ method of recovering hydrocarbons and similar thermally responsive constituents is to heat the contaminated soil to increase the vapor pressure and to remove such vapors by means of a drying atmosphere such as a steam sweep. Such methods are currently being tested wherein the necessary short-wave-band frequency apparatus heats from the surface down. If semi-volatiles and high boilers are to be removed, a steam sweep at a high temperature is preferable, and this can be realized by evaporating the moisture in the soil to provide an autogenous steam sweep, or by further heating to further increase the vapor pressure, thereby assuring almost complete recovery of the contaminants. However, the efficiency of such existing technology is reduced by the necessity of heating uncontaminated layers of overburden.

Petroleum-rich formations exist from which constituents can be effectively recovered if selectively heated, especially to temperatures at which the free water and much of the water-of-crystallization can be removed. Systems have been successfully developed and tested which employ rows of electrodes emplaced from mined galleries which, when excited by electromagnetic energy, uniformly heat such formations. Radiating antenna-like structures also have been proposed which might selectively heat such deposits. However, such antenna-like heating approaches have encountered problems, and to date few if any successful tests employing antenna-like structures have been reported.

Electromagnetic or radio frequency (RF) heating of earth media or reservoirs containing hydrocarbons or noxious volatile wastes has been the subject of some investigation over the last 10 to 20 years. The objective has been to heat the deposit to assist in the removal of valuable minerals such as oil, or noxious materials such as solvents and liquid fuels. In situ electromagnetic heating technology which has been disclosed to date falls into two major categories: A) bound-wave heating (either low or high frequency), and B) radiated wave heating (high frequency only).

Bound-wave heating structures are those in which the wave is largely contained within a specified volume and is not permitted to radiate significant amounts of energy. The original purpose of radiated wave structures (antenna), on the other hand, was to radiate waves into a lossless dielectric, such as air. Examples of the bound-wave approach appear in U.S. Reissue Pat. No. 30,738, and in U.S. Pat. Nos. 4,140,180, 4,144,935 4,499,585, 4,498,535 and 4,670,634. The successful application of the bound-wave process using the high frequency version is discussed in "Development of the IIT Research Institute RF Heating Process for In Situ Shale/Tar Fuel Extraction--An Overview", presented at the Fourteenth Oil Shale Symposium, Colorado School of Mines, Golden, Colorado, April 1981 by R. D. Carlson, et al. The successful use of a high frequency version of the bound-wave heating to decontaminate hazardous waste spills appears in "Radio Frequency Enhanced In Situ Decontamination of Soils Contaminated with Halogenated Hydrocarbons", presented in the proceedings of the Twelfth Annual Research Symposium, U.S. EPA, April 21–22, 1986, U.S. EPA Publication No. EPA/600/9-86/022 by H. Dev.

Direct application of radiated wave technology to heating lossy media such as soil has not achieved the same degree of success as bound-wave methods. Examples of direct application of antenna technology, intended for radiation in lossless media such as air, to heating lossy media appear in U.S. Pat. Nos. 4,301,865, 4,140,179, 4,457,365, 4,135,579, 4,196,329, 4,487,257, 4,508,168, 4,513,815, 4,408,754, 4,638,863, 2,757,738, 4,228,851, 3,170,519, and 4,705,108.

The lack of reported success in using the radiated wave approach in conductive earth media (as opposed to air) may be attributed to several possibilities. One possibility is that far field radiated wave technology, which was originally developed for radiation into lossless media such as air, has been incorrectly adapted for media which are highly conducting by comparison. Another possibility originates in the misconception that hydrocarbon material can be selectively heated to high temperatures, regardless of the soil matrix, even though such material is both finely divided and widely dispersed in the matrix. Such a misconception may have led to impractical equipment and negative results. An example of a radiating antenna structure designed to recover hydrocarbons (either contaminants or fuels) embedded in loss earth is described in U.S. Pat. No. 5,065,819.

A primary difficulty in directly applying the radiating antenna concept to lossy media is the nature of the very intense fields near the antenna. Such intense fields are of little concern in conventional radiating antennas operated in air, unless extremely high powered pulses are applied. In earth, such intense fields create hot spots which eventually lead to thermal breakdown of the soil. Published literature such as "Electromagnetic Field of an Insulated Antenna in a Conducting or Dielectric Media" by R. W. P. King, et al., IEEE Transactions on Microwave Theory and Techniques, Vol. MTT-31, No. 7, Jul. 1983, as well as results of computer programs, demonstrate that very intense and highly localized fields appear near the ends of dipole antennas and at the power input points (feed points), especially near sharp corners typically associated with such antenna designs. A consequence of disregarding the impact of such intense local fields at the feed point is that the earth medium may swell or melt, making it impossible to withdraw the fairly expensive antenna equipment, as has been known to occur in oil shale deposits. Examples of proposed technology to combat this particular problem, appear in U.S. Pat. Nos. 4,553,592, 4,576,231, and 4,660,636. In contrast, the heating near the electrodes in bound-wave heating of oil shale deposits is far more uniform, and causes much less swelling of the earth so that the electrodes may be easily extracted.

A further example of the use of the bound-wave approach to decontaminate hazardous waste spills is described in U.S. Pat. No. 4,670,634. An example of a radiating antenna structure embedded in lossy earth designed to recover hydrocarbons (either contaminants or fuels) is described in U.S. Pat. No. 5,065,819.

It has been contemplated in the prior art that more extensive radiative heating of the soil can be achieved using the radiating wave technique on account of the differences in dielectric properties of moist and dry soil. As the embedded antenna heats the soil in its immediate vicinity, moisture is boiled out, creating a steam sweep for use in flushing contaminants or hydrocarbons. This leaves the soil in the vicinity dry. The dielectric properties of such dry soil more closely approximates that of a lossless medium like air, and thus wave energy can be radiated through the dry soil to a greater distance with less attenuation than would be the case for moist soil. A significant problem, however, lies in achieving a uniform heating pattern for this purpose. Hot spots develop at certain locations around the exciters, while other locations remain moist. There is a need in the field to develop an apparatus which heats more uniformly and which mitigates the effects of these hot spots.

Yet another difficulty in directly applying the radiating antenna concept to lossy media is in determining how many exciter elements to use, and how closely to space them.

The development of an apparatus for selectively heating a subsurface layer, which does not need to be emplaced from mined galleries, would offer a more cost-effective removal of contaminants in layers substantially beneath the surface of the earth. It would also permit more cost-effective recovery of petroleum deposits which exist beneath an overburden and which require heating to over 100° C.

What is further needed is an apparatus having means for suppressing intense fields and excessive heating near the edges and power input points of the exciters.

There is a further need for an apparatus which can selectively heat a thin subsurface layer, without excessive loss of energy into uninteresting layers above and below.

Finally, there is need for an apparatus in which the exciters are spaced appropriately closely to achieve uniform heating throughout the formation.

SUMMARY OF THE INVENTION

The invention relates to methods and apparatus to selectively heat a layer of earth to remove thermally responsive constituents such as heavy oil or hydrocarbon-like contaminants. More specifically, it is related to methods and apparatus which heat the earth formation with medium-wave-band or short-wave-band energy to vaporize the water to reduce the lossiness of the formation, thereby increasing the extent of the heating pattern, and furthermore which have a steam distillation removal mechanism such that the hydrocarbon-like constituents are preferably removed as a vapor.

Methods and apparatus are disclosed which suppress intense electrical fields near edges and conduction discontinuities, such as power input points, on the exciters, thereby mitigating excessive heating and electrical breakdown of the soil. Insulation may be provided around the power input point of a dipole exciter, and edges and corners may be rounded to lessen field intensities.

In another embodiment of the invention, the electric field potential along the exciter is distributed, or stepped, by reactive elements such as capacitors and inductors, or distributed forms of such components. This distribution reduces the chance of electrical breakdown at the gap. The reactive mechanism may also take the form of an inductive coil, the tightness of which increases near the center of the gap. This coil may also contain a capacitive element in its core.

In yet another embodiment, a current probe may be positioned around the exciter to distribute the potential linearly along the length of the exciter covered by the probe. This distribution reduces the chance of electrical breakdown across the gap.

Further in accordance with the invention, the power, frequency and gap separation between dipole elements are controlled to mitigate excessive heating and more efficiently heat the formation. Measurements of temperature, electric field intensity, or other parameters may be used as feedback to determine whether to alter the applied power or frequency. In this way, cavity-resonant dry zones and other undesirable effects may be overcome.

In a further embodiment, several gaps designed according to the invention are positioned serially to comprise one exciter, and are powered in phase to achieve a heating pattern having a greater radial extent and a smaller angle of divergence. Selective heating of thin layers can thereby be efficiently achieved.

It is therefore a primary object of the invention to describe new and novel versions of EM/RF in situ heating processes which comprise field excitation structures of the type used to radiate signals in a lossless dielectric such as air, which create spatially non-uniform heating when immersed in a homogeneous time-invariant media, and which take advantage of the unique dielectric behavior of earth media when heated above the boiling point of water to reduce temperature disparities.

Another object is provide spacing relationships between adjacent antenna-like exciters so as to minimize power consumption.

Another object is to provide an improved antenna-like design that mitigates the undesirable effects of hot spots, thereby preventing electrical breakdown, especially near the feed points.

Another object is to provide a spacing relationship between adjacent antenna-like structures so as to limit the extent of the heated zone to the extent of the contaminated earth or oil reservoir.

Another object is to limit the heat loss to adjacent uncontaminated zones, thereby improving the thermal efficiency and reducing the power costs, while achieving decontamination within a reasonable time.

Another object is to remove the contaminants in vapor form rather than in liquid form to improve the overall recovery of volatile contaminants.

Another object is to describe in detail the parameters of the principal and ancillary equipments needed to either decontaminate hazardous waste spills or extract useful fuels from hydrocarbonaceous deposits.

DETAILED DESCRIPTION OF PREFERRED EMBODIMENTS

Figure 1:
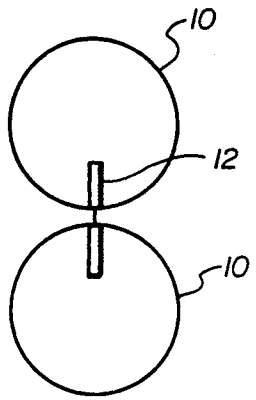
FIG. 1 is a sectional view of the near-field heating pattern from an electric dipole whose dimensions are very small compared to a wavelength.
Figure 2:
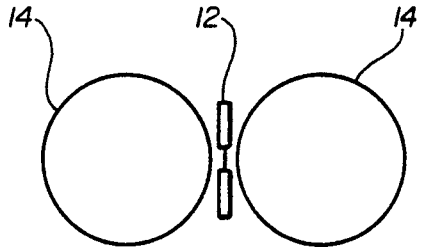
FIG. 2 is a sectional view of the far-field heating pattern as it is assumed to exist in a relatively lossy medium from a dipole whose dimensions are very small compared to a wavelength.

FIG. 1 illustrates the near field heating pattern, as identified by constant heating contour 10, associated with an electric dipole 12 which is very short compared to the wavelength of the applied signal. The orientation of this pattern is totally different than the far field heating pattern, shown in FIG. 2 as constant radiated power distribution contour 14, associated with the dipole 12 which is again small compared to the wavelength and which radiates into a lossless media, such as air. Basic confusion exists when inserting antennas, which have been optimized to radiate essentially in a lossless environment, into a media which is lossy. This would be the case where moist earth surrounds the antenna. Here, the near fields dominate and thereby provide the principal heating pattern until the moisture is evaporated from the earth near the antenna. In contrast to far field radiated power distribution, the principal heating in such a case is near the ends of the dipole, or "end-fire," rather than broadside.

Figure 3:
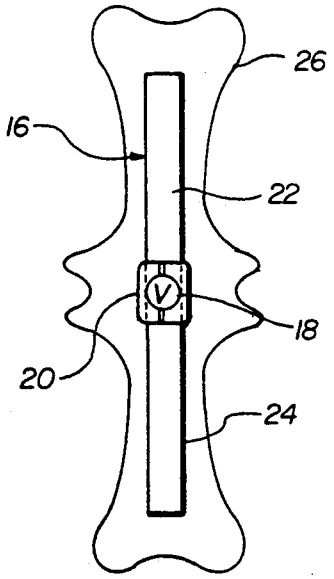
FIG. 3 is a sectional view of the near field heating pattern from a dipole whose dimensions are approximately one-half of the applied wavelength in a dielectric media.

FIG. 3 illustrates the near field heating pattern for a cylindrical dipole 16 immersed in a lossy medium, such as soil. The dipole 16 is driven by a voltage source 18. The gap between the two sections of the dipole is covered over by an insulator section 20. The upper portion 22 of and the lower portion 24 of the dipole 16 produce a near field constant heating contour 26. Note that excessive heating occurs near the edges of each of the cylindrical portions 22 and 24 of the dipole 16, with minimum heating patterns occurring in the vicinity of the mid-points of each of the dipole sections.

Figure 4:
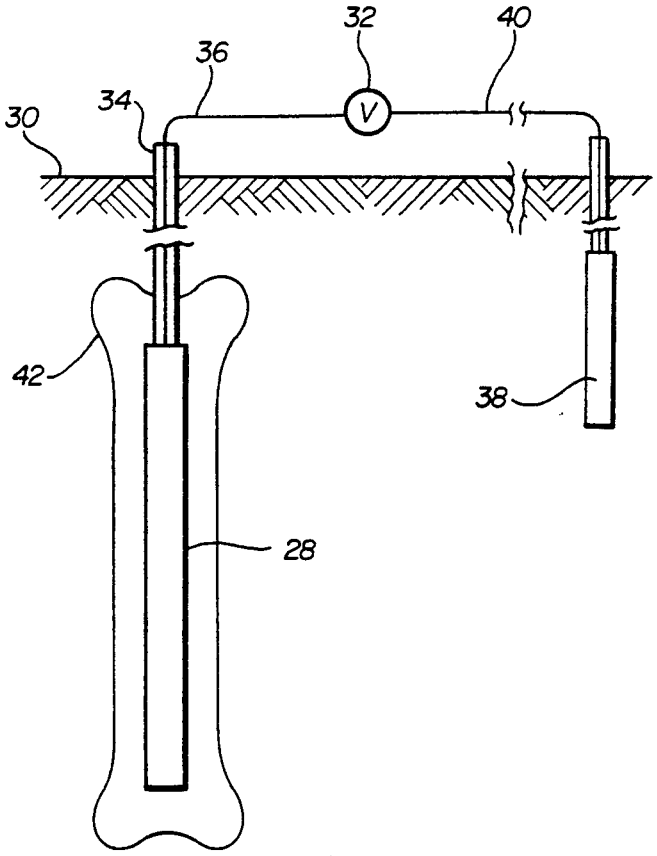
FIG. 4 is a sectional view of the near field heating pattern associated with a monopole whose dimensions are small compared to a wavelength when embedded in a dielectric medium, such as earth.

FIG. 4 illustrates a monopole 28 embedded in earth medium under the surface 30. The monopole 28 is driven by a voltage source 32 via an insulated cable 34 containing conductor 36. Excitation is applied with respect to a distant ground or a second monopole 38, which is powered over an insulated cable 40. Both monopoles are embedded substantially beneath the surface 30 of the earth. Upon excitation of monopole 28, a constant heating rate contour 42 is developed.

The "dog bone" heating patterns illustrated in FIGS. 3 and 4 arise because the charge distribution on the dipoles or antennas is non-uniform. In these cases, the electric charges repel each other and thereby collect near the ends of each of the conducting cylinders, especially near the edges. Since the current density is proportional to the charge density, and since the heating rate is proportional to the square of the current density (which is proportional to the charge density) times the resistivity of the media, very high heating rates can occur near such corners. If these hot spots are not properly treated, these can be the source of electrical breakdown or soil vitrification near the power feed points of antennas. The constant heating contour shown in FIG. 3 is appropriate for antennas operating at frequencies having any wavelength. The constant heating contour shown in FIG. 4 is more appropriate for lower frequencies where the antenna is small compared to a wavelength. The reason for this limitation is that the displacement currents can penetrate the insulation of the cable 34 as the frequency is increased, thereby limiting the usefulness of the arrangement shown in FIG. 4 to frequencies below a few tens of kHz.

Figure 5:
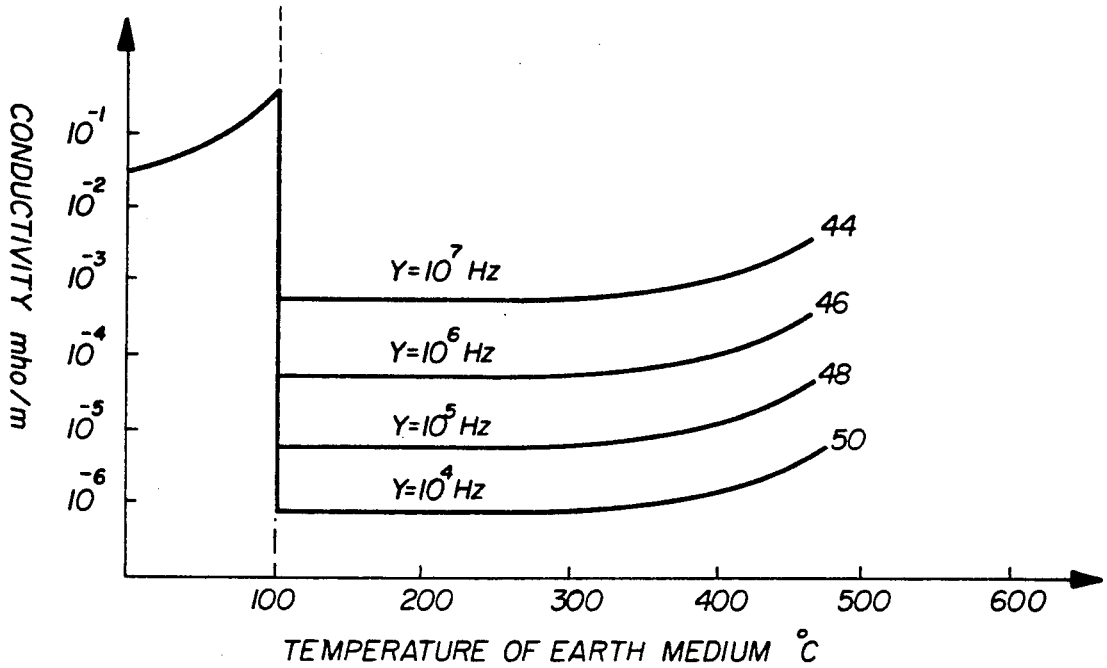
FIG. 5 is a graph of the conductivity of typical earth media as a function of the temperature of the earth media for different frequencies ranging from 10 kHz to 10 MHz.

FIG. 5 illustrates the conductivity in mhos per meter for typical earth media as a function of the temperature. Curves 44, 46, 48 and 50 represent frequencies of 10

MHz, 1 MHz, 100 KHz and 10 KHz, respectively. Dissipation of electrical energy in the media is directly proportional to the square of the field intensity times the conductivity. The conductivity may be determined from the curves appearing in FIG. 5 for a specific frequency of operation. Note that the conductivity increases as a function of temperature until the water is vaporized at 100° C. at point 52, after which the conductivity drops to a much lower level, to the order of about $10^{-6}$ mhos per meter for a frequency on the order of 100 kHz to about $10^{-3}$ mhos per meter for frequencies on the order of 10 MHz or higher.

A very low value of conductivity at temperatures above 100° C. suggests that a crude equivalent of far field operation can be realized if the antenna is supplied with sufficient power to vaporize the water around the gap at the feed point, as well as around the entire antenna itself. This further suggests that it may be possible to form a suitably focused "beam" with a vertical array of antennas of the same phase, thus forming a flat horizontal disc-shaped beam. Such an arrangement might boil its way through the earth out to the desired distance and heat a specified layer of the earth to about 100° C. Through such vaporization of the moisture content of the soil, highly conductive but electromagnetically lossy moist earth is replaced by low-loss dried earth of low conductivity. Such earth will permit propagation of radiated energy to a distance not otherwise possible for moist earth.

Several difficulties are attendant to the aforementioned concept. First of all, to vaporize water in a specified volume of earth, such as a right circular cylinder or a cube whose maximum dimensions are equal to the deposit thickness, a minimum number of kilowatt hours are required to raise the temperature sufficiently to vaporize this water such that the dielectric media will become low loss near the feed point of the antenna and subsequently well beyond. To do this, very high field intensities can be created next to the feed point. These can lead to excessive heating near the feed point even though the conductivity of the media has been significantly reduced by orders of magnitude unless proper design features are included.

Figure 6:
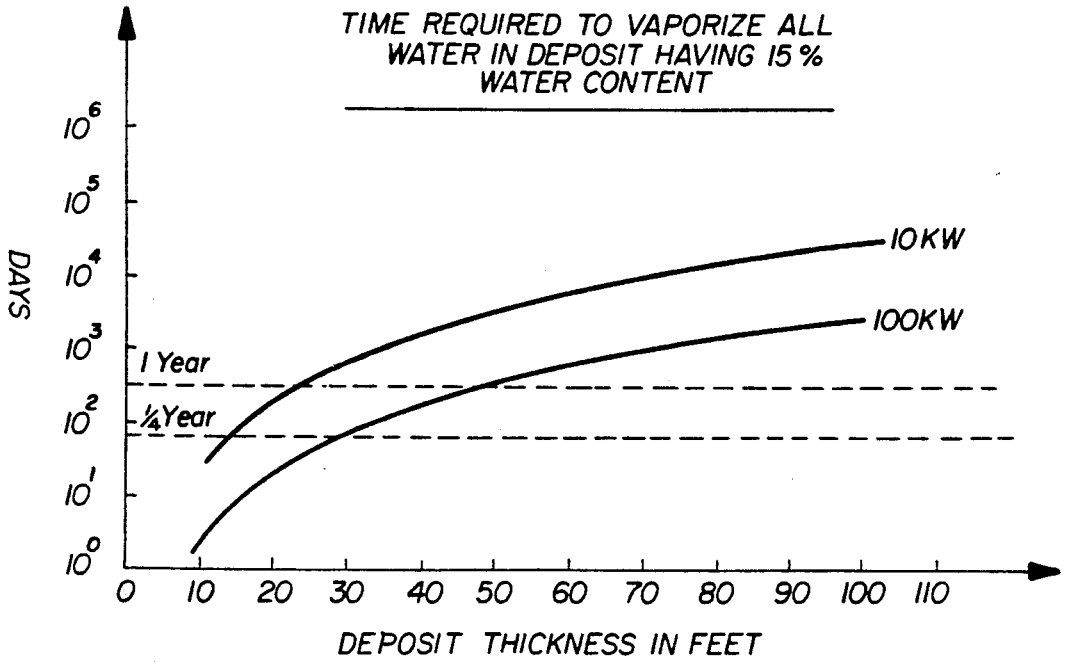
FIG. 6 is a graph of the number of days required to vaporize all the water in a deposit with 15% water content for an applied power of 10 or 100 KW as a function of deposit thickness and for feed point gap spacing between 1 and 2 meters. The volume of the deposit is assumed to be the cube of the deposit thickness.

Another difficulty is the power carrying capabilities of the practical coaxial cabling systems needed to carry the power to the antenna feed point. Typically, a 3⅛" coaxial cable can carry on the order of several hundred kilowatts of peak power which must be derated to account for standing waves. The average power capability will probably be reduced to about 100 kW under favorable conditions. It might be more practical to operate at reduced power, on the order of 10 kW, in order to reduce the buildup of excessive temperature. FIG. 6 illustrates the time required to completely vaporize the water in soil having 15% water content, as a function of deposit thickness for heating rates of 10 kW and 100 kW. The volume of the deposit is proportional to the cube of the deposit thickness for average power depositions of 10 kW and 100 kW. Note that approximately one year of application of 100 kW is required to vaporize the water in the deposit which has a thickness of 50 feet and that many years are required for the same thickness at the 10 kW level. The sheer problem of supplying adequate power in a reasonable time such that thermal diffusion is not excessive is a major design problem for the application of lower power around 10 kW.

The energy required to evaporate the water in a soil having a 15% moisture content is about 250 kWh/m$^3$, based on a specific heat for the soil of 0.3 Btu/lb-F°, a heat of vaporization of about 1000 Btu/lb.

The time, $t_d$ in hours required to vaporize the water becomes:

$$t_d = (\text{Vol. in m}^3)\,(2.5\times10^5\ Wh/m^3)\,(\text{power in kW})^{-1} \qquad (1)$$

Equation (1) defines the minimum value of time in terms of the applied radio frequency power for a given treatment volume needed to evaporate the moisture. Evaporation of the moisture is a mandatory requirement to realize an extended heating range. Otherwise, the heating pattern could not be extended much beyond a few meters or less because of skin depth absorption, which is typically less than 3 meters for moist soils for frequencies in excess of 1 MHz.

Figure 7A:
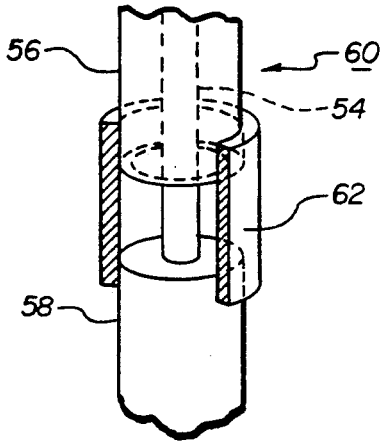
FIG. 7A is a sectional perspective of an electric dipole feed point having an outer layer of insulation.

A special problem is associated with electric fields near the gap since these are extremely intense and can cause excessive heating rates despite the reduction in conductivity after the vaporization point of water. FIG. 7A illustrates a possible gap design to mitigate excessive heating wherein the input power is carried by two conductors 54 and 56 of a coaxial cable. The inner conductor 54 of the coaxial cable is connected to the lower portion 58 of the dipole 60, while the outer conductor 56 comprises the upper portion of the dipole 60. Opposite polarities are applied to the conductors 54 and 56. The upper portion 56 and lower portion 58 of the dipole 60 are electrically isolated from each other by an insulator 62. The dipole 60 is immersed in a conducting medium such as moist earth.

Figure 7B:
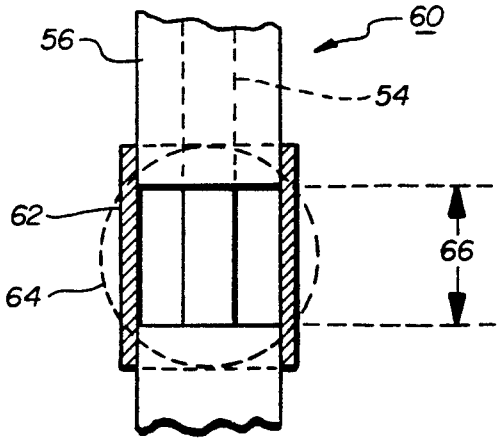
FIG. 7B is a sectional view of the approximately spherical heating pattern in the media near the dipole feed point shown in FIG. 7A.

The constant heating contour in the zone which is heated in the immediate vicinity of the dipole feed point may be approximated by a sphere 64, as shown in FIG. 7B. The radius of the sphere 64 is approximately equal to one-half the gap separation 66 and the volume of the sphere is proportional to the cube of the separation. Thus, the energy required to heat the spherical volume surrounding the gap to a temperature sufficient to cause catastrophic breakdown is proportional to the cube of the gap separation 66.

A typical coaxial cable which is required to deliver 10 kW produces about 1,000 volts between the inner conductor 54 and the outer conductor 56, assuming a standing wave ratio of 3. About 3,000 volts would be required between the inner and outer conductors of the coaxial cable in order to deliver an average power under typical standing wave conditions of 100 kW. The electric field between the two dipole sections 56 and 58 is inversely proportional to the spacing. The heating potential is proportional to the square of the electric field, and so the heating rate will be inversely proportional to the square of the spacing. When the electric field and heating parameters raise the temperature to a level above 300° C., as shown in FIG. 5, where the conductivity of the medium increases with temperature, a thermal runaway effect can initiate which leads to electrical breakdown.

Figure 8:
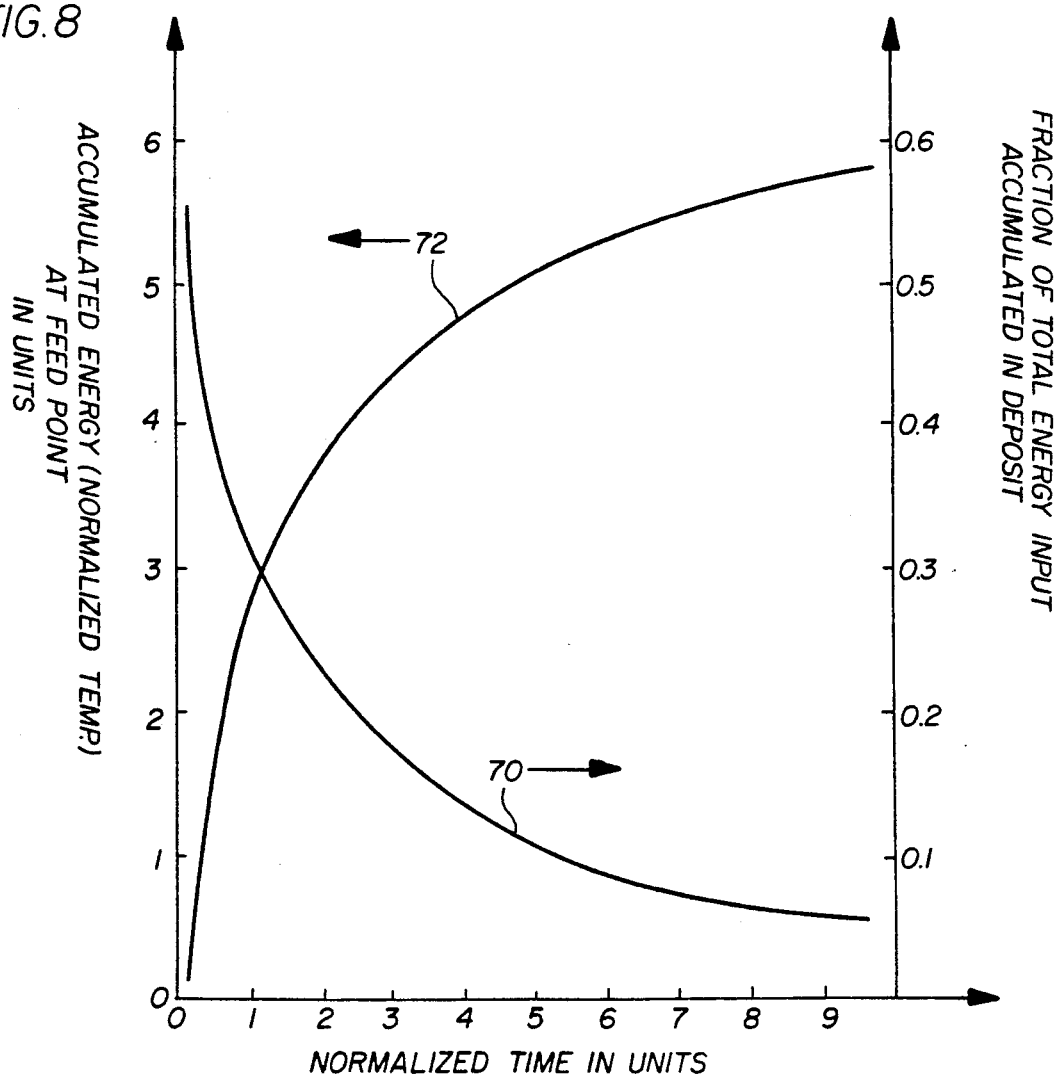
FIG. 8 is a graph showing the normalized temperature on the left ordinate and the fraction accumulated of total energy input on the right ordinate for the area around the feed point of an exciter emplaced in a dielectric medium like earth, as a function of normalized time for multiple feed point geometries between 0.2 and 2.0 meters.

If the earth surrounding the feed point of the dipole were a perfect thermal insulator, all that would be necessary to estimate the time to catastrophic failure would be the total energy accumulated in the sphere and the specific heat and volume. However, the earth is not a perfect thermal insulator. Thermal diffusion will reduce this peak temperature. Curve 70 of FIG. 8, read from the right ordinate, shows how the fraction of accumulated energy against total energy input is reduced as a function of normalized time for all gap spacings. Curve 72, read from the left ordinate, shows that the accumulated energy, and thus the temperature, increases and then begins to plateau, as the energy diffusing from the site begins to approach the amount of the energy being input to the site. The total thermal energy near the gap for the idealized thermally insulated system must be reduced by the fractions of the total thermal energy indicated by the ordinate on the right of the graph, on account of diffusion. Thus, for example, for 58 days of heating the idealized perfect thermal insulator temperature rise between the gaps must be reduced by a factor of 0.1, as illustrated in FIG. 8.

The approximate relation for determining the time to gap breakdown considers the following terms:

- P is the average power in watts supplied by the cable.
- V is the coaxial cable voltage at the feed point in volts.
- $Z_o$ is the characteristic impedance of the cable in ohms.
- $\gamma$ is the peak power enhancement factor due to impedance mismatch at feed point.
- S is the gap separation in m.
- h is the thickness of the deposit in m.
- $\sigma$ is the conductivity of the media around the gap in mhos/m.
- $E_{avg}$ is the approximate average electric field across the gap in V/m.
- $E_{en}$ is the enhanced electric field near corners in V/m.
- $E_{dis}$ is the energy dissipated needed to raise the temperature from 100° C. to 300° C. in the volume surrounding the gap.
- $\chi$ is the field enhancement factor.
- $\beta$ is the energy or temperature reduction factor due to thermal diffusion
- N is the number of gaps or feed points per antenna.
- tis the minimum time required to heat deposit to vaporize the moisture for a specified volume and applied power.
- $t_g$ is the time to gap breakdown temperatures.
- $\kappa_d$ is the thermal diffusivity $10^{-6}$ in $m^2$ per second.
- c is diffusion loss constant c=0.2 for 20-30% heat loss.
- $E_{acc}$ is the accumulated energy in the volume around the gap.

Heating and temperature conditions near the gap are controlled by the following equations. The voltage V across the gap will be equal to:

$$V = \left[\frac{(Z_o P\gamma)}{N}\right]^{1/2}. \tag{2}$$

The resulting average electric field $E_{avg}$ will be:

$$E_{avg} = \frac{V}{S}. \tag{3}$$

The enhanced electric field will be:

$$E_{en} = \left(\frac{V}{S}\right)\chi. \tag{4}$$

The power density $\rho$ near the gap will be:

$$\rho = \sigma (E_{en})^2 = \frac{\sigma P Z_o \gamma \chi^2}{NS^2}. \tag{5}$$

The energy accumulated in the sphere or cube surrounding the gap will be:

$$E_{acc} = \rho t_g S^3 \beta. \tag{6}$$

When this energy exceeds the energy $E_{dis}$ needed to heat the sphere above 300° C. (570° F.), then breakdown can develop:

$$E_{dis} = \left(\frac{0.2\ BTU}{\text{lb}\cdot{}^\circ\text{F.}}\right)\left(\frac{3600\ \text{lb}}{m^3}\right)(570\text{–}212^\circ\ \text{F.})\left(\frac{3410\ \text{BTU}}{kWH}\right)^{-1} S^3 \tag{7}$$

$$E_{dis} = 7.6 \times 10^4\ (S)^3/\text{watt-hours} \tag{8}$$

Whence:

$$t_g = \frac{(7.6 \times 10^4)\ (S)^3}{[\sigma P Z_o \beta \gamma \chi^2 S^3]}\ NS^3/\text{hours} \tag{9}$$

From Equation (1):

$$t_d = (\text{Vol. in m}^3)\ (2.5\times 10^5\ \text{Wh/m}^3)\ (P)^{-1}\ \text{hours} \tag{10}$$

Equating (9) and (10):

$$\frac{[\text{Vol}]}{P}\ [2.5 \times 10^5] = \left[\frac{7.6 \times 10^4 NS^2}{\sigma P Z_o \beta \gamma \chi^2}\right]. \tag{11}$$

Solving (11) for the gap spacing, S:

$$S = \left[\frac{(\text{Vol})(2.5 \times 10^5)\sigma Z_o \beta \gamma \chi^2}{7.6 \times 10^4 N}\right]^{\frac{1}{2}}. \tag{12}$$

Equation 12 relates the various factors which determine the gap separation S in an approximate fashion. A more rigorous analysis may be used to determine precisely the proper value of S. However, the minimum gap spacing can be approximated by choosing the lowest plausible values of the key factors in the equation. The plausible values are $\sigma = 2\times 10^{-5}$ mhos/m, $Z_o = 50\ \Omega$, $\gamma = 1.3$, $(\chi)^2 = 5$, and $\beta = 0.05$, yielding:

$$S \geqq \left(\frac{\text{Vol}}{N}\right)^{1/2} (3 \times 10^{-2}). \tag{13}$$

For a typical volume of $7\times 7\times 4\ m^3$ and N=1:

$$S \geqq 0.4\ \text{meters}. \tag{14}$$

Thus, wherein a typical cylinder diameter is in the range of about 0.15 to 0.2 meters for the above values, the gap spacing should exceed at least twice the diameter of the cylindrical antenna at the feed point. Note that gap spacings of less than 1.0 meter may lead to thermal runaway, whereas a gap spacing of 1.5 meters would be satisfactory for deposits up to 20 feet thick for both 10 and 100 kW sources.

Figure 9:
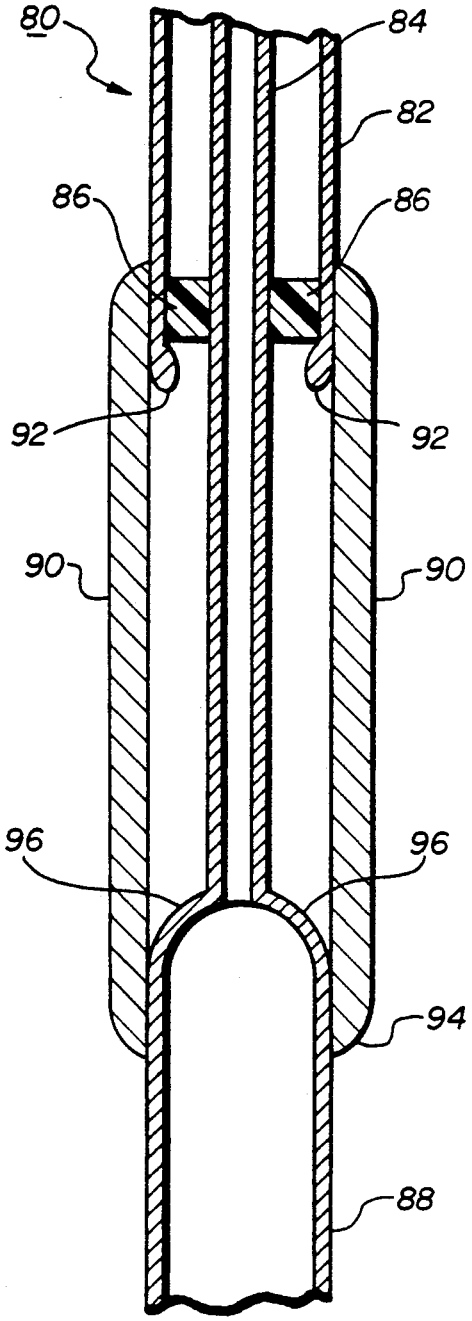
FIG. 9 is a sectional view of an antenna feed point design according to the invention which mitigates temperature buildup and reduces the chance of catastrophic breakdown by increasing the gap spacing and rounding edges.

FIG. 9 illustrates how such large gap spacings might be constructed. The upper part 80 of the antenna is comprised of a coaxial cable with an outer conductor 82 and an inner conductor 84. The inner and outer conductor of this cable are separated by an insulator 86. The lower section 88 of the antenna is separated from the upper section 80 by a robust low dielectric loss insulator 90 which is capable of withstanding temperatures of up to 300° C. All metal surfaces 92 and 96 and insulator edges 94 are rounded. Such a system begins to approach the requirements previously discussed, however charge accumulations near the opposite ends of the coaxial cable will still occur and may prove to be an additional problem beyond the gross solutions presented in FIG. 9. Some hot spots may still occur at points 96 and 92, despite the curved design and the thickness of the insulation.

Figure 10:
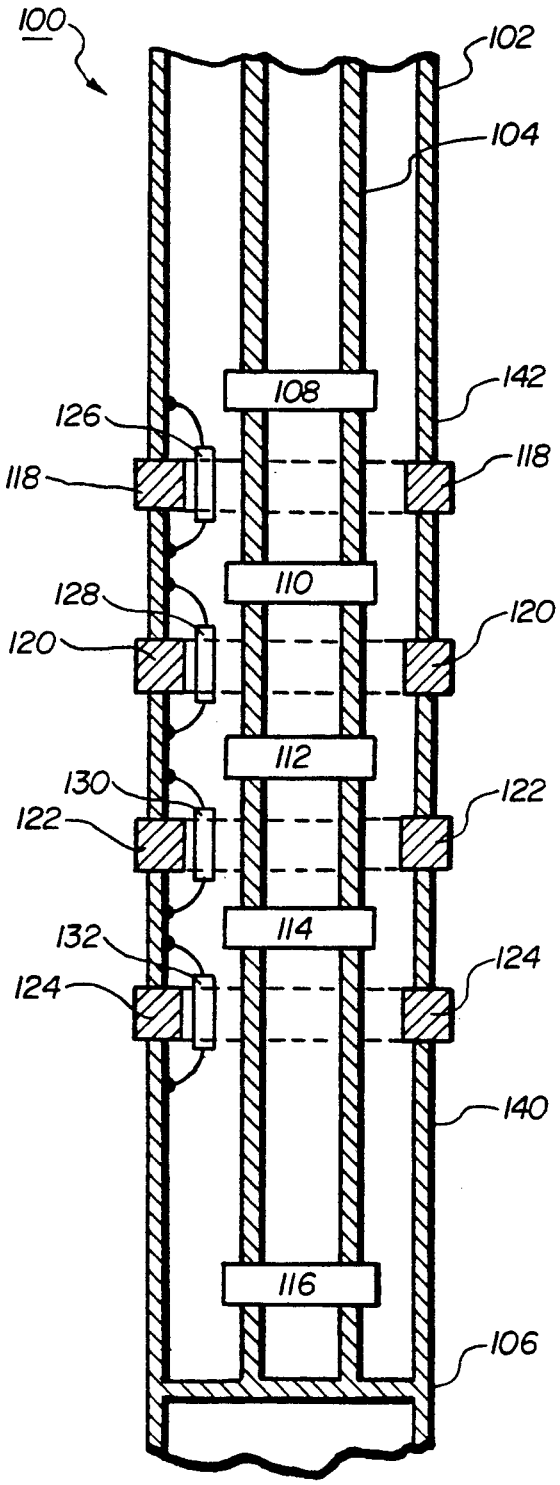
FIG. 10 is a sectional view of an improved gap design according to the invention wherein the electric field is more uniformly distributed by a capacitor voltage equalizing network.

To mitigate hot spots, as illustrated in FIG. 9, the electric field across the gap can be distributed. This can be achieved by means of resistive, capacitive or inductive potential dividers. The dividers have an impedance that is relatively small compared to the external loading applied to the gap under dried deposit conditions. FIG. 10 illustrates the use of a capacitive divider. The value of each of the capacitors are selected such that the electric field progressively increases toward the middle of the gap. This suppresses excessive charge concentration. The values of the capacitors are larger near the ends of the gap.

As illustrated in FIG. 10, the exciter now comprises a terminated coaxial cable 100 having an outer conductor 102 and an inner conductor 104, which provide the voltage to drive the gradient equalized gap system. The inner conductor 104 is connected to the lower portion 106 of the exciter via a series of in-line inductors 108, 110, 112 and 114. The inner conductor 104 may also be terminated prior to being connected to the bottom of the dipole via an additional impedance correction network 116. Insulators 118, 120, 122 and 124 interrupt the continuity of the outer conductor 102 over a distance which comprises the gap. Each of these smaller gaps are spanned by capacitors 126, 128, 130 and 132. The values of the capacitors and inductors and the frequencies of operation are chosen such that the sum of the inductive reactance of the series elements equals the sum of the capacitive reactance, thereby creating a near resonant condition in the exciter. The values of these elements are also chosen such that the impedance presented to the coaxial cable at a point above the in-line inductor 108 is between 5 and 500 ohms. Advantages of such an arrangement are that the peak electric fields near the smaller gaps are reduced because the potential is distributed, and that the electric field is more uniform. While charges and heat still accumulate above and below the distributed gap, these hot spots are not in positions where the excess heating can lead to catastrophic consequences. To minimize the accumulation of charges above and below the distributed gap, the values of the capacitors 128 and 130 near the mid-point should be smaller than the values of the capacitors 126 and 132 near the ends of the gap. This results in higher field intensities across the gaps at the mid-point and lower field intensities at the ends of the gap, thereby mitigating the charge buildup at positions 140 and 142.

Figure 11:
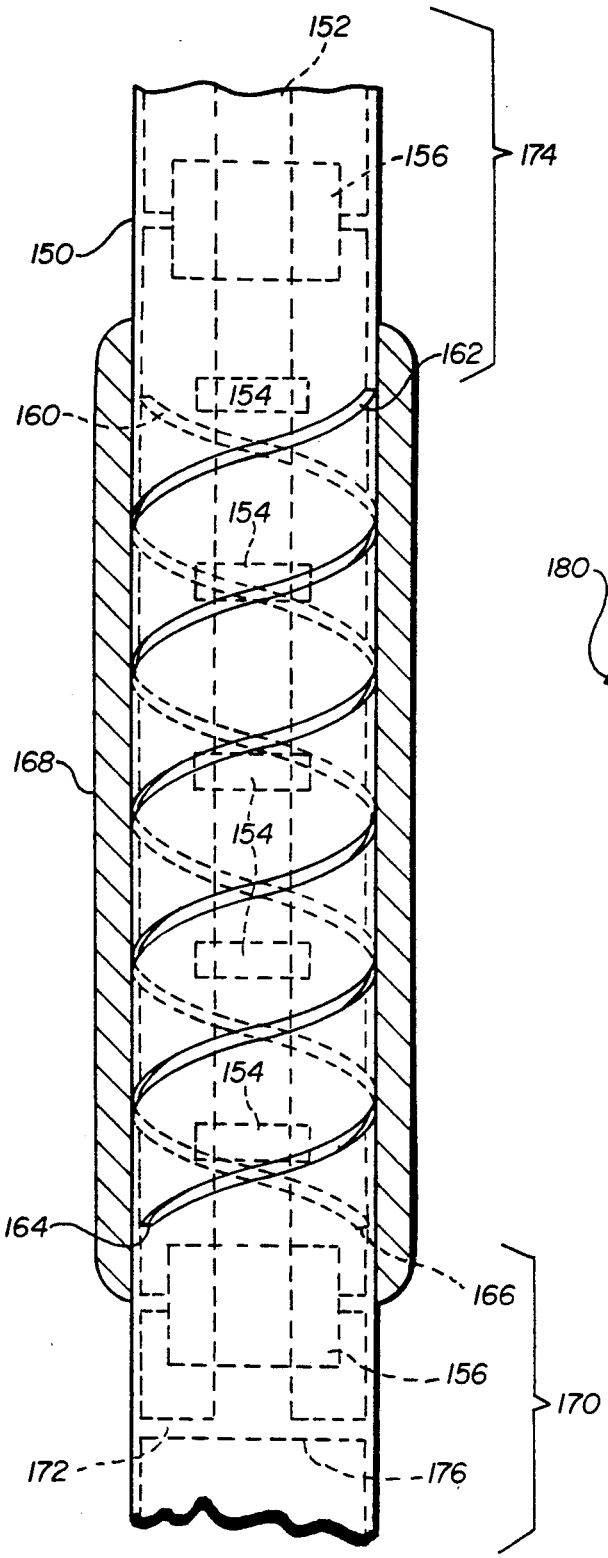
FIG. 11 is a sectional view of a further improved gap design according to the invention wherein the exterior of the antenna forms a resonant coil in the gap and the turns are spatially distributed to obtain a more breakdown resistant voltage gradient distribution across the gap.

An alternative to the capacitor voltage distributor arrangement shown in FIG. 10, is the inductive voltage distributor arrangement shown in FIG. 11. In this case, instead of exposing the capacitors on the outside of the exciter, the inductive coil is located at the outer surface of the coaxial cable, and the capacitors are retained within the antenna system. The outer conductor 150 and inner conductor 152 supply power via a set of series capacitors 154 and other types of impedance elements 156, to provide a voltage drop across the coil. The coil is formed from the metal of the outer conductor 150 of the coaxial cable by cutting a pair of spiral slots 160, 162 in the outer conductor thus forming two current pathways which wind about one another in a double helix. The slots are cut such that the helices are tighter toward the center of the slotted region, as shown in FIG. 11. The variable pitch double helix terminates at positions 164, 166. Above and below these positions, the coaxial cable is not slotted. As before, an outer insulated section 168 is provided to prevent ingress of fluids into this exciter section. The thickness of this insulator should be larger than the width of either slot 160, 162. Inner conductor 152 is supported at the distal end 170 by a support section 172, which also terminates the coaxial cable and provides a conductive connection between the inner conductor 152 and the outer conductor 150 by joining end wall 176. The slots 160 and 162 may tend to weaken the coaxial cable system itself, unless otherwise supported by the insulator 168 and support section 172. The arrangement illustrated in FIG. 11 decreases the charge buildup at the sections 170 and 174 of the exciter system. Electric field intensities between these sections are distributed and made more uniform by the combination of the inductive and capacitive reactance, the tightening helicity of the slots, and the insulation around the applicator section comprising the double helix. This distribution and equalization across the "gap" of the dipole reduces the risk of catastrophic breakdown around hot spots in the system.

Figure 12:
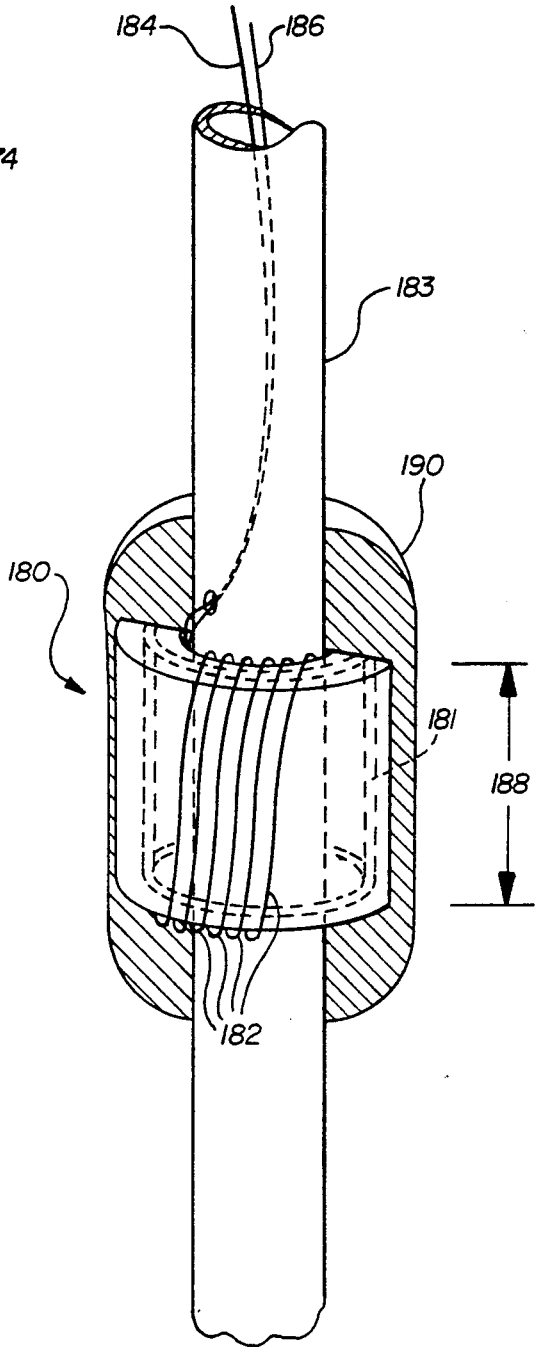
FIG. 12 is a sectional perspective view of a further gap design according to the invention using a toroidal current probe to evenly distribute a potential across the gap.

In another embodiment according to the present invention, a current probe may be used to distribute the potential across the gap. This is illustrated in FIG. 12, where a current probe 180, comprising a toroidal core 181, which may be a conductor such as iron, wrapped with wire as shown in the figure by exemplary windings 182, is positioned around a conductive, cylindrical rod 183. A potential is applied to the current probe 180 via input lines 184 and 186. This in turn induces a linear potential gradient in the cylinder along the length 188 occupied by the current probe 182. This in effect distributes the potential in the cylinder across the "gap" corresponding to the length 188 of the cylinder covered by the current probe. Insulation 190 may be positioned around the current probe as in previous embodiments to reduce the effect of hot spots, and prevent the ingress of moisture from the soil into the coil 182 of the probe 180.

All the systems shown in FIGS. 9, 10, 11 and 12 are designed to operate at wavelengths comparable to or larger than the "gap" spacing, the region of reactance-distributed potential. This is not for the purpose of forming narrow beams or angles of radiation, as might be suspected of multi-gap or distributed gap designs of one-half or one wavelength. Rather, the purpose is to eliminate electrical breakdown or overheating problems such as occur near a gap with a spacing smaller than two times the diameter of the cylindrical antenna-like exciter. As it turns out, then, the extent of each distributed gap is likely to be contained within one-half a wavelength, depending on specific operating parameters.

Figure 13:
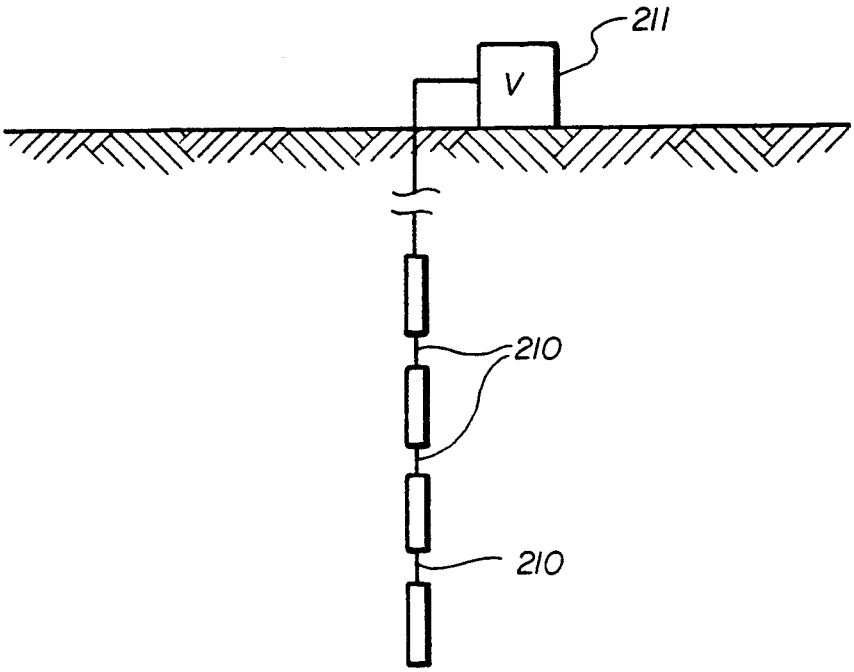
FIG. 13 is a view of an exciter according to the invention having multiple distributed gaps.
Figure 14:
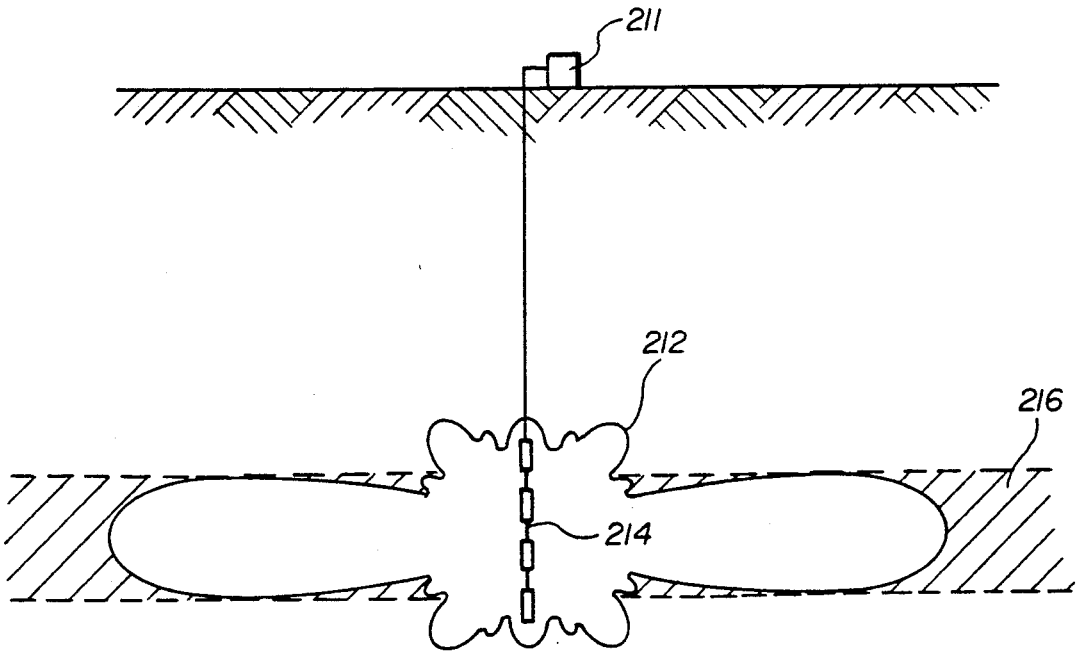
FIG. 14 is a sectional view of the heating pattern generated by the exciter shown in FIG. 13, which heats a narrow layer efficiently on account of interference patterns generated by the exciter subsegments.

However, it is often desirable to develop broadside beams with narrow angles of radiation in order to progressively dry out and heat relatively thin layers of soil. This may be achieved by a linear series of multiple distributed gaps, each designed as described above with respect to FIGS. 9, 10, 11 and 12, to provide equally phased vertical line sources for development of broadside arrays wherein the soil adjacent the exciter is progressively dried out. Such an apparatus is shown in FIG. 13. The "gap" sections 210 of distributed potential are designed according to one of the embodiments described above, and each may comprise an isolated dipole having its own power lines, arranged coaxially with other dipoles, or each may comprise a gap in a long, serial multipole having just one set of power lines, with the potential distributed across multiple steps, each step being one distributed gap. Each is driven in phase with the others by power source 211 at the surface, resulting in interference patterns in the far-wave regime which tend to narrow the beam width so that most of the radiated energy is deposited in the desired thin layer. A typical far field energy deposition pattern for such an exciter arrangement is shown in FIG. 14, where the equal energy deposition surface contour 212 emanating from exciter 214 is shown in section. Energy is narrowly deposited in the desired layer 216.

In addition to the problem of gap breakdown, additional problems exist in trying to establish the development of a dehydrated region, the radial extent of which substantially exceeds the maximum dimension of the array itself. For example, as the material is progressively dehydrates out from the exciter itself, it will tend to form a cavity resonator. This occurs because of a significant wave impedance mismatch which may exist between the dried material and the moist material. The moist material exhibits a very low wave impedance, on the order of 10 ohms, while the dried material exhibits a relatively high wave impedance, on the order of 200 ohms. This can, in effect, form a cavity wall which reflects much of the energy incident on the border of the cavity back toward the exciter. This can increase the voltage near the exciter and decrease the power which can be deposited via gaps into the deposit itself. Such a buildup of the electric field near the gap due to cavity resonances can be reduced by shifting the frequency. Precursors of such a buildup of the electric field can be sensed by measuring the impedance or voltage at the gap. A substantial increase in the impedance or voltage can be used as the criterion for changing the frequency. However, as indicated by FIG. 5, attenuation at higher frequencies can be significant and this can lead to more rapid buildup of heat near the feed point. This buildup of temperature can be mitigated by sensing the temperature at the feed point and educing the applied power such that the temperature near the gap does not exceed 300° C. or the temperature rating of the electrical insulation surrounding the gap.

Figure 15:
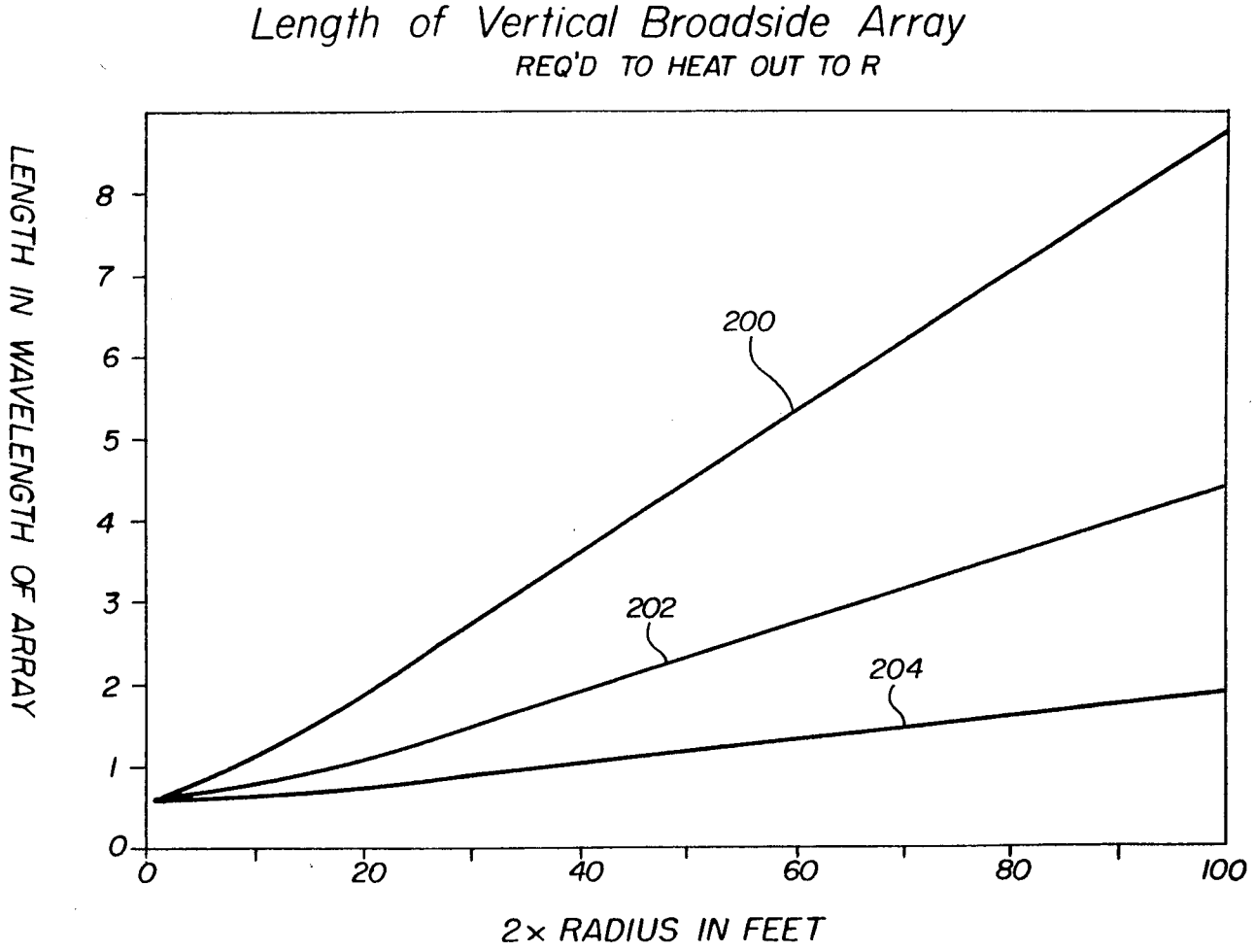
FIG. 15 is a graph of the length of a vertical broadside array in wavelengths needed to selectively heat deposit thicknesses of 10, 20, and 50 feet out to a given radial distance.

FIG. 15 illustrates the difficulty in heating thin layers of soil out to more than a few dozen feet. For such thin layers (less than 30 feet thick), relatively high frequencies are needed. At these high frequencies, the buildup of heat near the gap will increase in proportion to the increase in $\sigma$, the conductivity of the soil around the gap.

Shown in FIG. 15 is the radial distance R as the abscissa and the length $L_1$ of the vertical array in wavelengths as the ordinate. The curves 200, 202 and 204 correspond to the array lengths required to heat out to the radial distance for various deposit thicknesses of 10, 20 and 50 feet, respectively. Also shown are the frequencies of operation required to obtain a reasonably compact broadside pattern whose beam width $\Theta$ in degrees is defined by:

$$\Theta = 50\,(L_1)^{-1}. \tag{15}$$

The electrical length $L_1$ of the vertical array can be restated in terms of the deposit thickness h and the radial distance R, so that:

$$L_\lambda \geqq 50\left(\tan^{-1}\frac{h}{2R}\right) \tag{16}$$

Looking back at FIG. 5, the conductivity for dried soil (>>100°) for typical mixtures of top soil and clay is shown. The values shown, however, can range higher by a factor of 3 and lower by an order of magnitude for variations in soil mixtures. Nominally, as shown in FIG. 5, dried soil conductivity as a linear function of frequency becomes:

$$\sigma(f) = (f\,\mathrm{MHz})\,(10^{-4})\ \mathrm{mhos/m} \tag{17}$$

The electromagnetic wave, as it progresses away from the antenna-like exciter in the dried soil (T>100° C.) experiences a power wave attenuation of:

$$P(R_w) = P(R_1)^{-2\alpha R2}\ \mathrm{watts} \tag{18}$$

where $P(R_2)$ is the power dissipated in the dried soil at radius $R_2$ and $R_1$ is the radius of the exciter. The attenuation constant $\alpha$ becomes:

$$\alpha = \frac{\sigma_1 Z_1}{2} \approx 100\alpha\ \mathrm{nepers}/m \tag{19}$$

where $\sigma_1$ is the conductivity at the frequency of interest, and $Z_1$ is the characteristic wave impedance of the media which is typically about 200 ohms for dried soil.

To assure that most of the power is dissipated at the interface between the dry and moist zones, the frequency may be chosen according to the following equations. Attenuation of the wave to half power is given by:

$$e^{-2\alpha R2} > 0.5 \tag{20}$$

whence:

$$2\alpha R_2 < 0.7 \tag{21}$$

$$R_2 < 0.35\,[100\sigma]^{-1} \tag{22}$$

$$R_2 < \frac{35}{[f\,MHz]} \tag{23}$$

and for sandy soils:

$$R_2 < \frac{350}{[f\,MHz]} \tag{24}$$

Thus, for clay-like soils, the maximum radius would be about 3.5 meters for operation at 10 MHz Consequently, deposit thicknesses of much less than 20 feet may not be amenable to selective heating at any reasonable distances beyond 15 to 30 feet by antenna-like exciters which produce narrow "pancake" beams.

The relations defined in the above equations also define the spacing between adjacent antenna-like exciters. To determine the spacing, the conductivity of the dried soil throughout the layer of interest can be measured either by making dielectric measurements on a complete vertical set of soil cores or by observing the attenuation experienced by the waves emitted from a pilot antenna-like installation for a given site. From these data, the spacing between wells would be no more than 2 times $R_2$.

Figure 16:
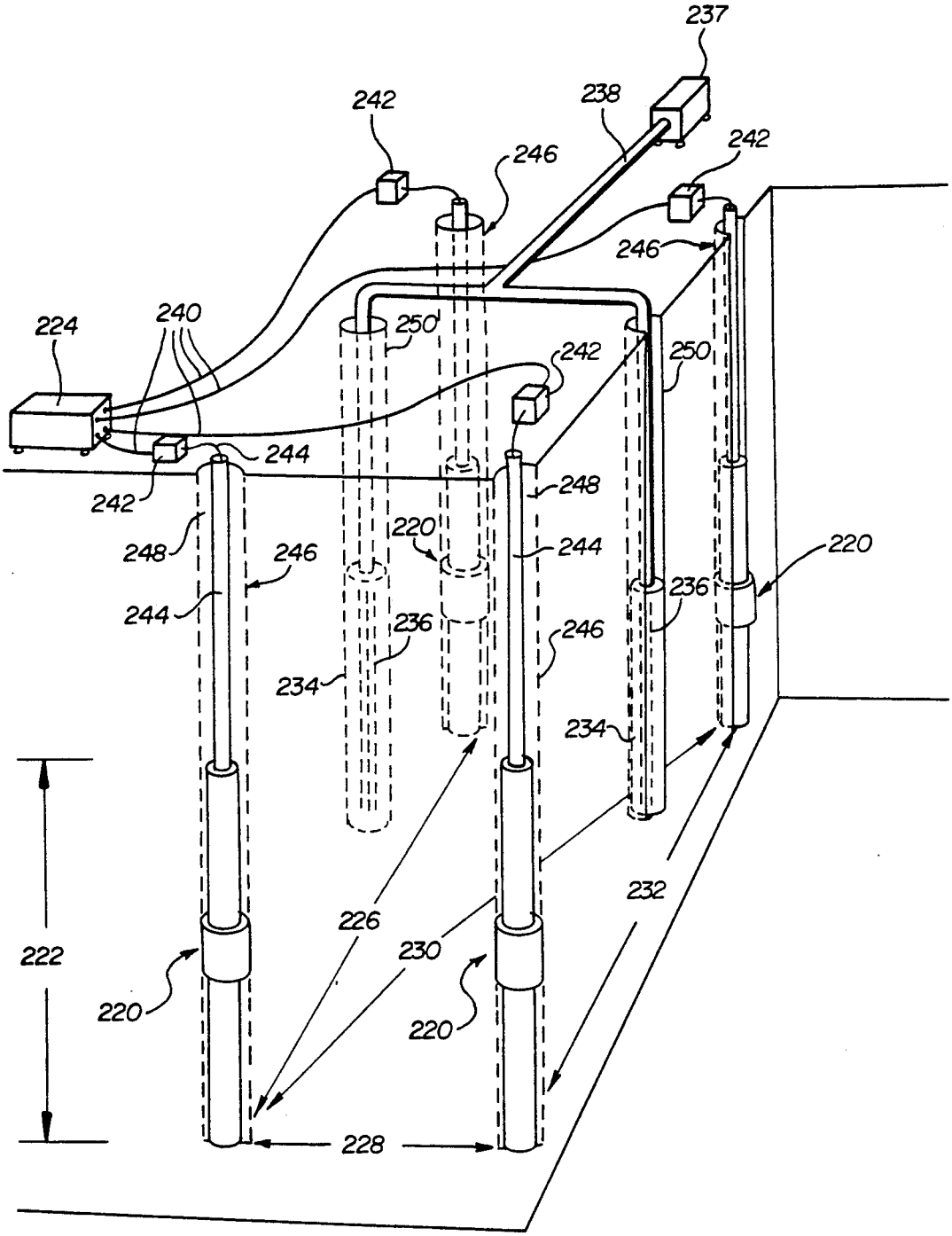
FIG. 16 is a sectional perspective of a complete radio frequency heating system to decontaminate or produce fuels from a specific zone, beneath the surface of the earth.

FIG. 16 illustrates one overall embodiment of the heating system of the present invention. This figure shows buried field exciters 220 in the contaminated section 222 of the deposit which are energized from a radio frequency source 224, as appropriate for the needs of the heating program. These exciters are separated by the distances 226, 228, 230, 232 and so on, as required to obtain the required heating pattern in terms of the amount of power available for each exciter. In this embodiment, the heated vapors are withdrawn via high temperature ($T>>120°$ C.) resistant plastic pipes 234 having perforations 236 whereby heated vapors are carried to a vapor treatment system 237 via ducts 238. All duct work 238 associated with the vapor collection system is heat traced or thermally insulated, including that duct work which is below the surface of the earth.

The fluid withdrawal system for the embodiment shown in FIG. 16 uses production wells or product withdrawal wells which are separate from the antenna-like exciters. This is done to simplify the design, since the cost of boring additional wells from the surface to 300 feet is relatively small. On the other hand, if processing at depth is desired, a different fluid withdrawal arrangement may be needed which shares the same bore hole as the antenna-like exciter. Such a system is described in U.S. Pat. No. 4,524,827. Here, the product flow lines and production tubing would also be thermally insulated or heated if only vapor recovery of contaminants were required. Tubing heating apparatus for such antenna-like heating systems noted in U.S. Pat. No. 4,524,827 is described in U.S. Pat. 4,790,375.

Each of the antenna-like exciters 220 is fed coaxial cables 240 via matching networks 242 and cables 244. The antenna-like exciters 220 are emplaced in bore holes 246. After emplacement, a clay slurry or grout 248 is used to seal the portions of the bore hole above the antenna-like exciters 220 to prevent unwanted escape of vapors. The pipes 234 for the vapor extraction system are similarly emplaced in bore holes 250 located between the antenna-like exciters. Grout or clay slurries are used to seal the uppermost portion of these bore holes as well.

An alternative method to prevent excessive buildup of temperature near the gaps of the antenna-like exciter would be to inject water into the vicinity of each gap. Apparatus capable of doing this function are described in U.S. Pat. No. 4,524,827, with the modification that the flow direction of liquids, in this case water, is reversed so as to inject water into the formation near the gap via the tubes normally used for product recovery. This arrangement is relatively simple but does require a separate heated vapor recovery well. If the apparatus is required to both heat and recover vapors, then a second tubing system dedicated to water injection is needed which is almost identical to the production tubing in U.S. Pat. No. 4,524,823. This second tubing would also be insulated from the casing and would follow the same path as the production tubing except that it would be connected to a source of cooling water on the surface.

In accordance with the previous discussion, the preferred spacing in the present invention for the linear antenna-like exciters embedded in the earth is determined by doubling the radial extent $R_2$ found using equation (20). The design of the antenna-like exciters may be like that shown in FIG. 9, employing a single feed point. Alternatively, multiple feed points spaced at least one-half wavelength apart may be used in combination in a single vertical exciter, as in FIG. 13. Each of the feed points may be designed according to one of the embodiments of the present invention shown in FIGS. 9, 10, 11, and 12, which comprise distributed feed points or "gaps". Each feed point must be of the same phase as the adjacent ones, thereby providing a linear vertical antenna with a broadside radiation pattern, as shown in FIG. 14. To further assure breakdown-free operation, water can be injected into the formation in the vicinity of the gaps. Further, the frequency can be shifted in response to measurements in the gap of impedance or voltage or other indicative parameters, to avoid cavity resonances which may exacerbate the heating rate near the gap. Temperature monitoring sensors near the gap or impedance measuring sensors at the surface can be used to determine the times to inject water or shift the frequency, or alternatively to adjust the power applied.

The foregoing describes an in situ heating system which is designed to vaporize the moisture content of the soil in order to extend the range or reach of the heating pattern in the subsurface formation. Another objective of vaporizing the moisture is that it creates a steam sweep system wherein the presence of steam dries out hydrocarbon contaminants which have a boiling point well in excess of the temperature of the deposit. For example, in a test where approximately 25 tons of the deposit were heated to a temperature of 150° C., it was possible using a steam sweep to remove nearly 80% of the hydrocarbon contaminants with boiling points near 300° C. or above. Such a system can be effective for semi-volatiles such as diesel and jet fuel and high boilers such as PCBs and PCPs.

Figure 17:
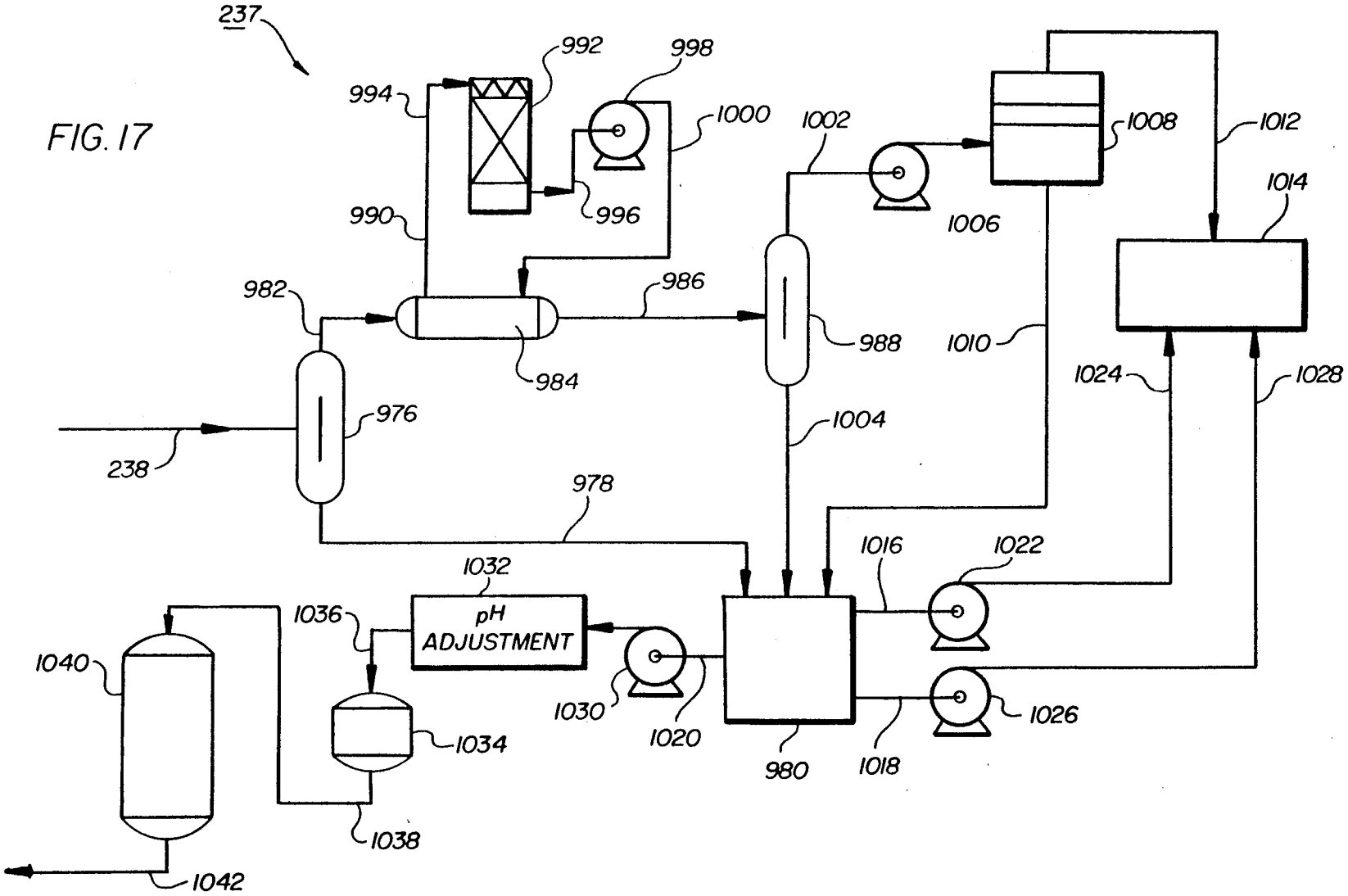
FIG. 17 is a block diagram of the effluent treatment system for the in situ decontamination process.

The vapor collection and disposal system 237 of FIG. 16 is shown in greater detail in FIG. 17. A gas-liquid separator 976 is connected to the line 238 and receives the fluid stream therefrom. Separated liquids are fed via a line 978 to a liquid-liquid separator 980. Separated gases are fed via a line 982 to a condenser-cooler 984 where heat is removed from the fluid stream, allowing some of the vapors to condense. The cooled vapors are output, along with the liquid, via a line 986 to a gas-liquid separator 988. In order to ensure adequate cooling, a cooling loop 990 is provided having a cooling tower 992 connected to an input line 994 from the condenser-cooler 984. The cooling tower 992 transfers heat from a water stream to the atmosphere, and cooled water is fed from the cooling tower through a line 996 to a pump 998 and thence through a line 1000 to the condenser-cooler 984.

The gas-liquid separator 988 has an output gas line 1002 and a liquid line 1004 connected thereto. The gas line communicates with a fan 1006, the output of which is connected to a demister 1008. The line 1004 supplies liquid to the liquid-liquid separator 980 as does an output line 1010 from the demister 1008. Gases from the demister 1008 are fed via a line 1012 to a catalytic incinerator 1014 used for non-chlorinated contaminant. When chlorinated contaminant is to be treated a chiller and associated carbon bed adsorber are substituted for the catalytic incinerator 1014. The liquid-liquid separator 980 has an output light organic phase line 1016, an output heavy organic phase line 1018, and an output water line 1020 connected thereto. A light organic phase pump 1022 feeds the light organic phase material from the line 1016 through a light organic phase line 1024 to the incinerator 1014, delivering waste light organic compounds, such as hexane and heptane, to the incinerator 1014. A heavy organic phase pump 1026 feeds material from the line 1018 through a heavy organic phase line 1028 to the incinerator 1014 for feeding heavier organic compounds such as kerosene recovered from the site contaminated region to the incinerator 1014 where they are oxidized. Water from the contaminated region is fed by a line 1020 to a pump 1030 which delivers the water to a pH adjuster 1032 for neutralizing any acidity in the water. The water is then filtered by a pressure filter 1034 connected to a line 1036 between the pH adjustor 1032 and the pressure filter 1034. An output line 1038 from the pressure filter 1034 supplies pH 7.0 filtered water to a carbon bed absorber 1040 which removes any remaining contaminants from the filtered water to generate a treated water stream in an output line 1042 for use in other portions of the equipment.

What is claimed is:

1. An apparatus for high frequency in situ heating of subsurface formations for recovery of thermally responsive constituents, comprising:

high frequency power supply means, and an exciter emplaced in said subsurface formation disposed to radiate said high frequency power, said exciter comprising:

a first conducting cylinder having edges, a second conducting cylinder having edges and being positioned coaxially to said first conducting cylinder so there remains a gap therebetween, and gap insulation means for electrically insulating said gap between said first and second conducting cylinders for suppressing excessively heated regions near the edges and a power input point of said exciter and thereby providing substantially uniform heating of said subsurface formation.

2. An apparatus according to claim 1, wherein said gap is at least twice the diameter of said cylinders.

3. An apparatus according to claim 1, wherein said exciter further comprises a plurality of conducting cylinders, positioned coaxially and each separated from the next by a gap, the dimension S in meters of said gap being related to the volume V in cubic meters of earth to be heated and the number N of gaps, by the equation:

$$S \geqq (V/N)^{0.5} (3^0 \times 10^{-2}).$$

4. An apparatus according to claim 1, wherein said conducting cylinder comprises:

an outer conducting cylinder, an inner conducting cylinder positioned coaxially inside said outer cylinder, and wherein said suppressing means comprises at least one electric field distribution means located along said exciter, disposed to equally distribute an electric field potential over a length between the upper portion of said exciter above said distribution means and the lower portion of said exciter below said distribution means, thereby mitigating intense electric fields over the length between the portions and minimizing excessively heated regions around said exciter.

5. An apparatus according to claim 3, wherein said electric field distribution means comprises a combination of capacitors and inductors.

6. An apparatus according to claim 5, wherein said electric field distribution means comprises:

a plurality of capacitors in electrical series located between the upper portion of said outer cylinder and the lower portion of said outer cylinder, and a plurality of inductors in electrical series located between the upper portion of said inner cylinder and the lower portion of said inner cylinder, and wherein said inner cylinder terminates at its lower end in a conducting connection with said outer cylinder.

7. An apparatus according to claim 6, wherein the applied frequency, the capacitances of said capacitors and the inductances of said inductors are chosen such that the sum of the inductive reactance approximately equals the sum of the capacitive reactance.

8. An apparatus according to claim 6, wherein the applied frequency, said capacitors and said inductors are chosen such that the impedance of the exciter is in the range of about 5 ohms to about 500 ohms.

9. An apparatus according to claim 6, wherein the capacitance of said capacitors decreases with proximity to the middle of said series of capacitors.

10. An apparatus according to claim 6, wherein said electric field distribution means comprises:

an inductor coil formed from a middle section of said outer cylinder by at least two helical, non-intersecting slots cut into said outer cylinder between the upper portion of said outer cylinder and the lower portion of said outer cylinder, a plurality of capacitors in electrical series located between the upper portion of said inner cylinder and the lower portion of said inner cylinder, and wherein said inner cylinder terminates at its lower end in a conducting connection with said outer cylinder.

11. An apparatus according to claim 10, wherein the applied frequency, the capacitances of said capacitors and the inductances of said inductor coil are chosen such that the sum of the inductive reactance approximately equals the sum of the capacitive reactance.

12. An apparatus according to claim 10, wherein the applied frequency, said capacitors and said inductors are chosen such that the impedance of the exciter is in the range of about 5 ohms to about 500 ohms.

13. An apparatus according to claim 10, wherein the helicity of said slots increases with proximity to the middle of said inductor coil.

14. An apparatus according to claim 10, further comprising an insulating jacket around said inductor coil to mitigate excessive heating and prevent the ingress of moisture from the surrounding soil into the apparatus.

15. An apparatus according to claim 14, wherein the width of said helical slots is substantially less than the thickness of said insulating jacket.

16. An apparatus according to claim 5, further comprising:

means for measuring any of the set of temperature, impedance, or electric field strength at said electric field distribution means, and means for adjusting any of the set of the frequency applied to said exciter, the power applied to said exciter or the impedance of said electric field distribution means in response to said measurements to limit heating around said distribution means.

17. An apparatus according to claim 4, wherein the electrical length of said electric field distribution means is less than one half of the wavelength applied to the exciter.

18. An apparatus according to claim 4, wherein said exciter further comprises a plurality of said electric field distribution means arranged linearly along the length of the exciter, at regular intervals on the order of the wavelength of the frequency applied to said exciter, all said distribution means thus being excited in phase, such that interference patterns in the radiated energy cause substantially all of the energy to be deposited in a thin layer of the formation.

19. An apparatus according to claim 1, wherein the electrical length $L_\lambda$ of said exciter, in wavelengths of said high frequency as measured in dried earth, is selected according to the equation:

$$L_l \geqq 50\ [\tan^{-1}(h/2R)]$$

where h is the deposit thickness and R is the radial distance from said exciter out to which the formation is to be heated.

20. An apparatus according to claim 1, further comprising a plurality of said exciters, wherein said exciters are emplaced such that the distance between adjacent exciters is determined from the equation:

$$D < 0.70/(100\sigma)$$

where $\sigma$ is the conductivity in mhos per meter of the dried soil at the frequency applied to the exciters.

21. An apparatus according to claim 1, further comprising:

means for collecting vapors from said subsurface formation, heated ducts for transporting said collected vapors from said collection means without condensing said vapors, means disposed to receive said transported vapors for separating at least one constituent of said vapors from other constituents by condensation of said one constituent from said vapors, means for removing hazardous hydrocarbon vapors from said vapors by catalytic incineration or carbon bed absorption, and means for removing organic phase contaminants from said condensate.

22. A method of suppressing intense electric fields and excessively heated regions of an exciter having a plurality of poles, the excessively heated regions being between said poles in an apparatus for high frequency in situ heating of subsurface formations for recovery of thermally responsive constituents, comprising the steps of:

applying a high frequency signal to said exciter, equally distributing the electric field across the distance between the poles with elements providing electrical reactance, thereby mitigating intense electric fields and excessively heated regions around the exciter between the poles providing substantially uniform heating of said subsurface formation, measuring any of the set of temperature, impedance, of electric field strength in the area between said poles, and adjusting any of the set of the frequency applied to said exciter, the power applied to said exciter or the exciter impedance in response to said measurements to limit heating in said area.

* * * * *

UNITED STATES PATENT AND TRADEMARK OFFICE

CERTIFICATE OF CORRECTION

PATENT NO. : 5,293,936

DATED : March 15, 1994

INVENTOR(S) : Bridges

It is certified that error appears in the above-indentified patent and that said Letters Patent is hereby corrected as shown below:

IN THE CLAIMS:

Column 17, Line 54, change "3°" to --3--;

Column 18, Line 3, change "3" to --4--;

Column 18, Line 29, change "6" to --5--;

Column 19, Line 21, change "$L_1$" to --Lλ--;

Column 20, Line 31, change "of" to --or--.

Signed and Sealed this

Sixteenth Day of August, 1994

*Attest:*

*Attesting Officer*

BRUCE LEHMAN

*Commissioner of Patents and Trademarks*